US006655569B1

(12) United States Patent
Greenhill et al.

(10) Patent No.: US 6,655,569 B1
(45) Date of Patent: Dec. 2, 2003

(54) POWER ACTUATED TOOL AND SHROUD FOR USE WITH THE TOOL

(75) Inventors: Silviu Greenhill, Bentleigh (AU); Robert Urqhart Connell, Hawthorn (AU)

(73) Assignee: Cetram Pty. Limited, Moorabbin (AU)

( * ) Notice: Subject to any disclaimer, the term of this patent is extended or adjusted under 35 U.S.C. 154(b) by 0 days.

(21) Appl. No.: 09/979,038

(22) PCT Filed: Apr. 11, 2000

(86) PCT No.: PCT/AU00/00304

§ 371 (c)(1),
(2), (4) Date: Mar. 14, 2002

(87) PCT Pub. No.: WO00/71305

PCT Pub. Date: Nov. 30, 2000

(30) Foreign Application Priority Data

May 21, 1999 (AU) ..... PQ0505

(51) Int. Cl.[7] ..... B25C 1/12; B25C 1/18; B25C 1/14

(52) U.S. Cl. ..... 227/9; 227/10; 227/147; 173/DIG. 2

(58) Field of Search ..... 227/9, 10, 147; 173/DIG. 2

(56) References Cited

U.S. PATENT DOCUMENTS 3,804,314 A * 4/1974 Gilbert ..... 227/10
4,056,935 A * 11/1977 Gassmann ..... 173/DIG. 2
5,016,802 A * 5/1991 Haytayan ..... 227/9

* cited by examiner

*Primary Examiner*—Rinaldi I. Rada
*Assistant Examiner*—Michelle Lopez
(74) *Attorney, Agent, or Firm*—Lowe Hauptman Gilman & Berner LLP

(57) ABSTRACT

A power actuated tool (20) for driving a fastener into a substrate such as steel or concrete, comprises a housing (2), a barrel assembly (5) mounted to the housing, and a piston displaceable within the barrel assembly upon firing of the tool to drive a fastener from the forward end (25) of the barrel into the substrate, at least a forward end of the barrel assembly being mounted for axial movement relative to the housing whereby firing of the tool requires the forward end (25) of the barrel assembly to be pressed against the substrate to cause retraction of the forward end relative to the tool housing. A telescope shroud (21) surrounds the forward end of the barrel assembly to at least partially suppress noise emission resulting from firing of the tool.

3 Claims, 2 Drawing Sheets

POWER ACTUATED TOOL AND SHROUD FOR USE WITH THE TOOL

This invention relates to power actuated tools and more particularly to explosively actuated tools for driving a fastener such as a pin into a substrate such as concrete or steel.

Explosively actuated tools which are used to fire fasteners into a hard substrate such as concrete or steel generally have an associated recoil action during which noise resulting from the firing procedure is emitted. Such a tool typically comprises a barrel from which the fastener is expelled by means of the piston driven by detonation of the explosive charge. The detonation of the explosive charge results in recoil of the tool and combustion gasses subsequently being vented from the barrel at high pressure and velocity to thereby generate a loud noise emission.

The invention seeks to reduce noise emissions in power actuated tools.

In accordance with the invention, there is provided a shroud for use with a power actuated tool for firing a fastener into a substrate, the shroud being adapted to couple between a main barrel and a slidable front barrel of the tool and being adapted to extend from a collapsed condition when a mouth of the front barrel is positioned adjacent to a substrate into which a fastener is to be fired and an extended condition when the main barrel is in a recoiled position relative to the front barrel after firing the tool, wherein the shroud defines a cavity to at least partially contain noise emission from the main barrel resulting from the tool firing of the tool.

Further according to the invention, there is provided a power actuated tool for driving a fastener into a substrate such as steel or concrete, said tool comprising a housing, a barrel assembly mounted to the housing, and a piston displaceable within the barrel assembly upon firing of the tool to drive a fastener from the forward end of the barrel into the substrate, at least a forward end of the barrel assembly being mounted for axial movement relative to the housing whereby firing of the tool requires the forward end of the barrel assembly to be pressed against the substrate to cause retraction of the forward end relative to the tool housing, said tool further comprising a shroud surrounding the forward end of the barrel assembly to at least partially suppress noise emission resulting from firing of the tool.

The invention is more fully described, by way of non-limiting example only, with reference to the accompanying drawings, in which.

Figure 1:
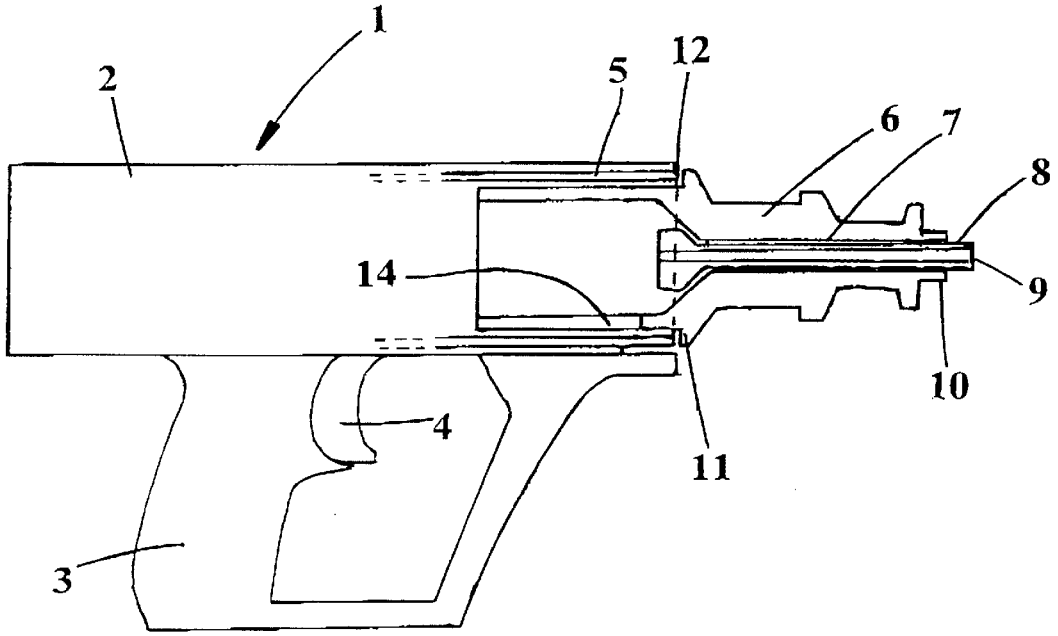
FIG. 1 is a partial cross-sectional side view of a known form of power actuated tool.

The known tool 1 shown in FIG. 1 includes a housing 2, a hand grip 3 and a trigger 4. A barrel assembly comprising a main barrel 5 extends into the housing 2 and receives a front barrel 6 therewithin for axial slidable movement relative to the main barrel. The barrel 6 has a central bore 7 which in turn receives a fastener guide 8 which has a free end 9 projecting from a muzzle 10 of the front barrel 6. The front barrel 6 also has an annular shoulder 11 for abutment with a mouth 12 of the main barrel 5.

Figure 2:
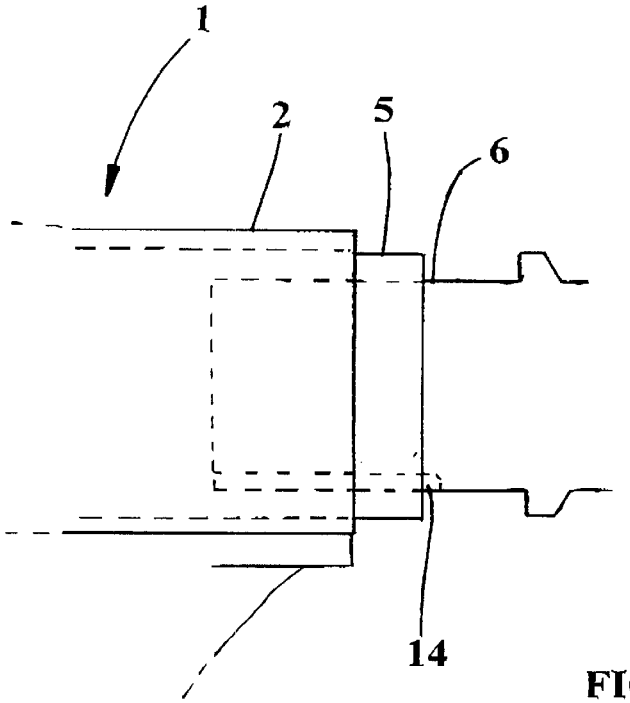
FIG. 2 is a partial side view of the tool of FIG. 1, showing the configuration of the barrel assembly upon recoil after firing in a recoiled position.

In use of the tool 1, a fastener is inserted in the free end 9 of the fastener guide 8 and the forward end of the tool is pressed against a substrate into which the fastener is to be fired. The pressure causes the fastener guide 8 to retract into the front barrel 6 and possibly the entire barrel assembly to retract which releases a safety lock of the tool 1 and places the muzzle 10 in direct abutment with the substrate. Such safety mechanisms which enable firing of the tool only when the forward end of the barrel assembly is pressed against the substrate are well known in tools of this type. The trigger 4 may then be actuated to detonate an explosive charge via an appropriate firing mechanism to force a piston along the barrel 5 and through the fastener guide 8 to directly impact with the fastener and drive it into the substrate. When the charge detonates, a recoil action causes the housing 2 to move rearwardly relative to the front barrel 6. Relative displacement between the front barrel 6 and the main barrel 5 exposes an exhaust aperture 14, as represented in FIG. 2, to allow combustion gases within the barrel 5 to be vented to the atmosphere. The high pressure and velocity of the gases causes a considerable noise to result.

Figure 3:
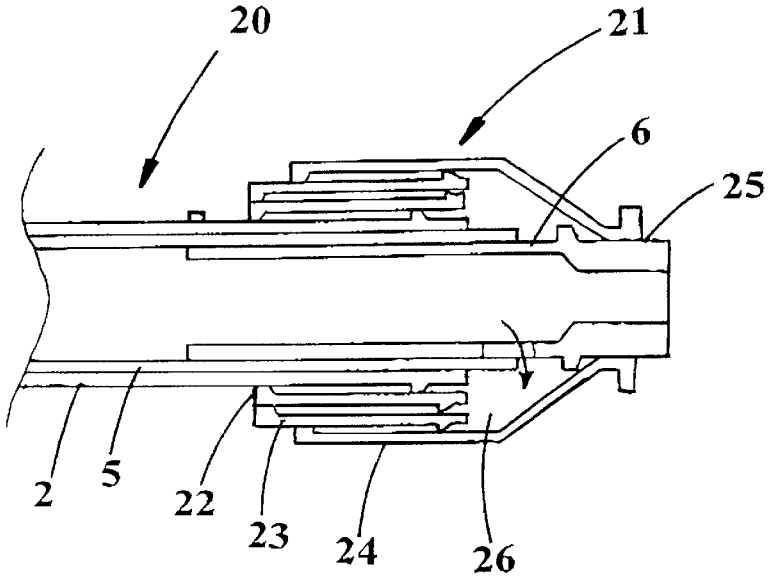
FIG. 3 is a diagrammatic cross-sectional view of a power actuated tool, including a shroud, in accordance with the invention.

The tool 20 of the present invention is shown in FIG. 3. Only the main and front barrel region of the tool is shown since the other parts of the tool are otherwise similar to those of the tool 1, described with reference to FIGS. 1 and 2 and like parts are denoted with similar reference numerals. Like the tool 1, the tool 20 includes a housing 2 with a main barrel 5 and a front barrel 6, however the tool 20 has a shroud 21 coupled therebetween. The shroud 21 includes a plurality of telescopically connected sleeves 22, 23 and 24. Although as shown there are three sleeves, other embodiments may consist of only two sleeves, or more than three sleeves. The sleeve 22 is slidably mounted about the housing 2 surrounding the main barrel 5 whereas the sleeve 24 is secured to a front portion 25 of the front barrel 6 by suitable attachment means.

Figure 4:
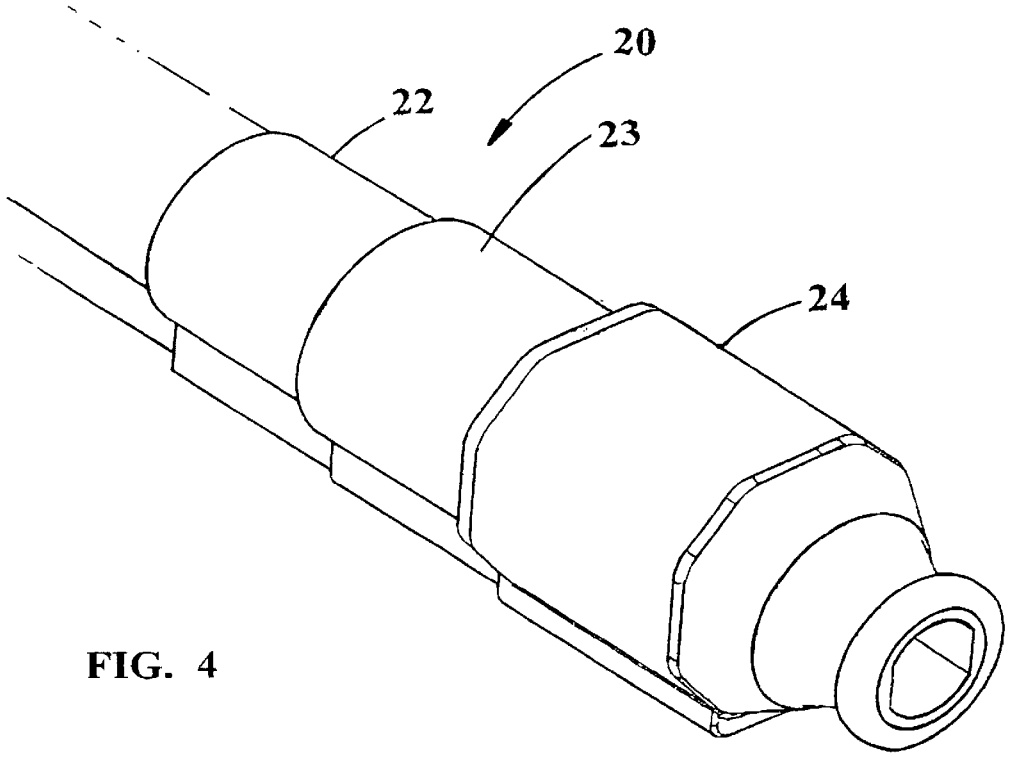
FIG. 4 illustrates the tool of FIG. 3 with the shroud in an extended condition after firing.

Accordingly, relative axial movement between the front barrel 6 and the main barrel 5 results in corresponding movement of the sleeves 22, 23 and 24. When the front barrel 6 is in the pre-firing condition, similar to that shown in FIG. 1, the sleeves are in a collapsed condition as shown in FIG. 3. However, relative movement between the barrels 5,6 as will occur on recoil after firing will result in the shroud 21 extending as shown in FIG. 4 whereby any gases vented from within the barrel exit directly into a cavity 26 defined by the shroud 21. As such, noise emissions may be substantially reduced. Performance of the invention has been demonstrated with a prototype as being capable of achieving a noise reduction from 114 dB to 106 dB. After initial capture of the combustion gases, the gases may exit to atmosphere from the tool in a laminar fluid flow between the sleeves 22 to 24 which are not a tight fit one relative to the other.

After firing, the front barrel 6 can be retracted relative to the main barrel 5 by grasping the front sleeve 24 of the shroud 21 and displacing the sleeve 24 rearwardly to collapse the shroud. This movement of the front barrel 6 may also serve to facilitate resetting of the piston into the rear of the barrel assembly in preparation for a subsequent firing.

In addition to reducing noise emissions, the shroud fully encases the components of the tool between the housing 2 and the front portion 25 of the front barrel 6 such that cycling of the tool in a conventional manner, results in the shroud 21 being fully extended in the manner illustrated in FIG. 4. The shroud thereby serves to protect the internal components of the tool from the environment and contaminants such as dust or other particulate matter. Accordingly, the shroud 21 can assist in increasing the working life and reliability of the tool whilst also providing an aesthetically pleasing external appearance.

The shroud 21 and tool 20 have been described by way of non-limiting example only and many modifications and variations may be made thereto without departing from the spirit and scope of the invention as hereinbefore described.

Throughout this specification and claims which follow, unless the context requires otherwise, the word "comprise", and variations such as "comprises" or "comprising", will be understood to imply the inclusion of a stated integer or group of integers or steps but not the exclusion of any other integer or group of integers.

What is claimed is:

1. A shroud for use with a power actuated tool for firing a fastener into a substrate, the shroud being adapted to always couple between a main barrel and a slidable front barrel of the tool and being adapted to extend from a collapsed condition when a mouth of the front barrel is positioned adjacent to a substrate into which a fastener is to be fired and an extended condition when the main barrel is in a recoiled position relative to the front barrel after firing the tool, wherein the shroud defines a cavity to at least partially contain noise emission from the main barrel resulting from firing of the tool;

wherein said shroud comprises three telescopically arranged sleeves.

2. A power actuated tool for driving a fastener into a substrate, said tool comprising:

a housing;

a barrel mounted to the housing and having a forward end being moveable relative to the housing in an axial direction of said barrel;

a piston displaceable within the barrel upon firing of the tool to drive a fastener from the forward end of the barrel into the substrate; and an expandable and collapsible shroud linking the forward end of the barrel with the housing at all times, so as to at least partially suppress noise emission resulting from firing of the tool;

wherein said shroud is a hollow tube that fits over the front end of said barrel and a front portion of said housing, an entirety of said hollow tube being moveable, in said axial direction, relative to said housing.

3. A power actuated tool for driving a fastener into a substrate, said tool comprising:

a housing;

a barrel mounted to the housing and having a forward end being moveable relative to the housing in an axial direction of said barrel;

a piston displaceable within the barrel upon firing of the tool to drive a fastener from the forward end of the barrel into the substrate; and an expandable and collapsible shroud linking the forward end of the barrel with the housing at all times, so as to at least partially suppress noise emission resulting from firing of the tool wherein said shroud comprises three telescopically arranged sleeves.

* * * * *